US006230454B1

(12) United States Patent
Meagher

(10) Patent No.: US 6,230,454 B1
(45) Date of Patent: May 15, 2001

(54) UNIVERSAL MODULAR TREAD AND RISER UNIT

(76) Inventor: Timothy D. Meagher, 6175 Canyon Ferry Rd., Helena, MT (US) 59602

( * ) Notice: Subject to any disclaimer, the term of this patent is extended or adjusted under 35 U.S.C. 154(b) by 0 days.

(21) Appl. No.: 09/231,849

(22) Filed: Jan. 14, 1999

(51) Int. Cl.[7] ..... E04F 11/00

(52) U.S. Cl. ..... 52/182; 52/190; 52/188; 52/191; 52/187; 52/88

(58) Field of Search ..... 52/182, 188, 191, 52/98, 100

(56) References Cited

U.S. PATENT DOCUMENTS

| | | | | |
|---|---|---|---|---|
| 5,791,101 | * | 5/1999 | Wallace | 52/191 |
| 5,806,254 | * | 9/1998 | Bennet | 52/182 |
| 5,899,032 | * | 8/1998 | Buzby | 52/182 |

* cited by examiner

*Primary Examiner*—Carl D. Friedman
*Assistant Examiner*—Patrick J. Chavez
(74) *Attorney, Agent, or Firm*—Richard C. Conover

(57) ABSTRACT

A universal modular tread and riser unit for positioning on a stairway stringer having a predetermined slope. The unit, including an elongate tread wall having two ends including a connecting end and a free end. An elongate riser wall having two ends including a connecting end and a free end. The riser wall having its connecting end joined to the connecting end of the tread wall with the riser wall oriented in a depending perpendicular relation to the tread wall. A pair of spaced apart vertical side walls is secured on either side of the connected tread wall and riser wall. The side walls are spaced apart sufficiently to receive a stairway stringer with the free end of the tread wall resting on the stringer and the free end of the riser wall resting on the stringer. The tread wall having a breakaway portion located at the free end of the tread wall for sizing the length of the tread wall between the ends of the tread wall, and the riser wall having a breakaway portion located at the free end of the riser wall for sizing the length of the riser wall between the ends of the riser wall.

2 Claims, 4 Drawing Sheets

UNIVERSAL MODULAR TREAD AND RISER UNIT

BACKGROUND OF INVENTION

This invention relates to a universal modular tread and riser unit for mounting on a stairway stringer for supporting a tread and a riser of a stairway, which unit includes structure for accommodating a stairway of any pre-selected rise and length. Once the rise and length of the stairway is selected, all of the units used with the stairway can be sized at one time for forming a stairway having the pre-selected rise and length.

Metal channels have been used for forming a stairway. See for example, U.S. Pat. No. 4,635,416 to Ayala. With this apparatus, each channel must be positioned individually to accommodate a stairway having a pre-selected rise and length.

U.S. Pat. No. 4,709,520 to Vochatzer shows stair brackets that must be individually positioned to accommodate a stairway of pre-selected rise and length. Guide tabs are provided to locate the bracket on a stringer having a pre-selected slope.

Other modular stair forming units are shown in U.S. Pat. No. 5,293,722 to Reimann and U.S. Pat. No. 5,806,254 to Bennett.

From the above it can be seen that what is needed is a universal modular tread and riser unit for mounting on a stairway stringer, which unit includes structure for accommodating a stairway of any pre-selected rise and length. Once the rise and length of the stairway is selected, it is desirable to have all all of the units used with the particular stairway sized easily at one time. It is further desirable to have the capability of mounting all of these units to a stairway stringer with the unit properly positioned on the stringer to have the treads horizontal and the risers vertical.

SUMMARY OF INVENTION

A universal modular tread and riser unit for positioning on a stairway stringer having a predetermined slope. The unit, including an elongate tread wall having two ends, including a connecting end and a free end. An elongate riser wall having two ends, including a connecting end and a free end. The riser wall having its connecting end joined to the connecting end of the tread wall with the riser wall oriented in a depending perpendicular relation to the tread wall. A pair of spaced apart vertical side walls is secured on either side of the connected tread wall and riser wall. The side walls are spaced apart sufficiently to receive a stairway stringer with the free end of the tread wall resting on the stringer and the free end of the riser wall resting on the stringer. The tread wall having a breakaway portion located at the free end of the tread wall for sizing the length of the tread wall between the ends of the tread wall, and the riser wall having a breakaway portion located at the free end of the riser wall for sizing the length of the riser wall between the ends of the riser wall.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 3:
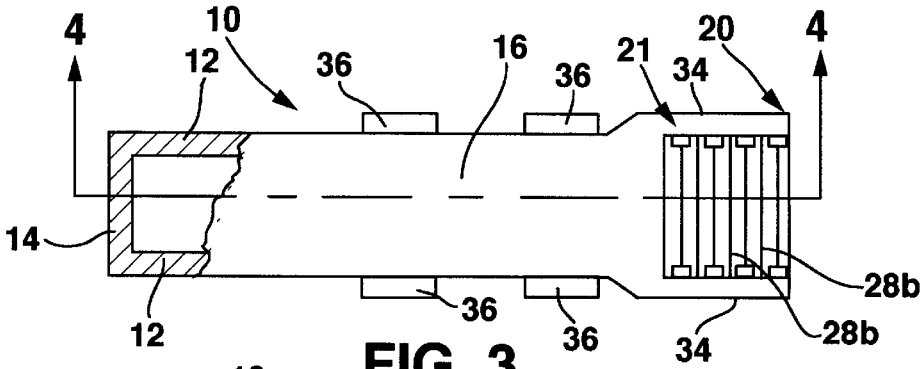
FIG. 3 is a top plan view of the invention shown in FIG. 2 with parts broken away.
Figure 2:
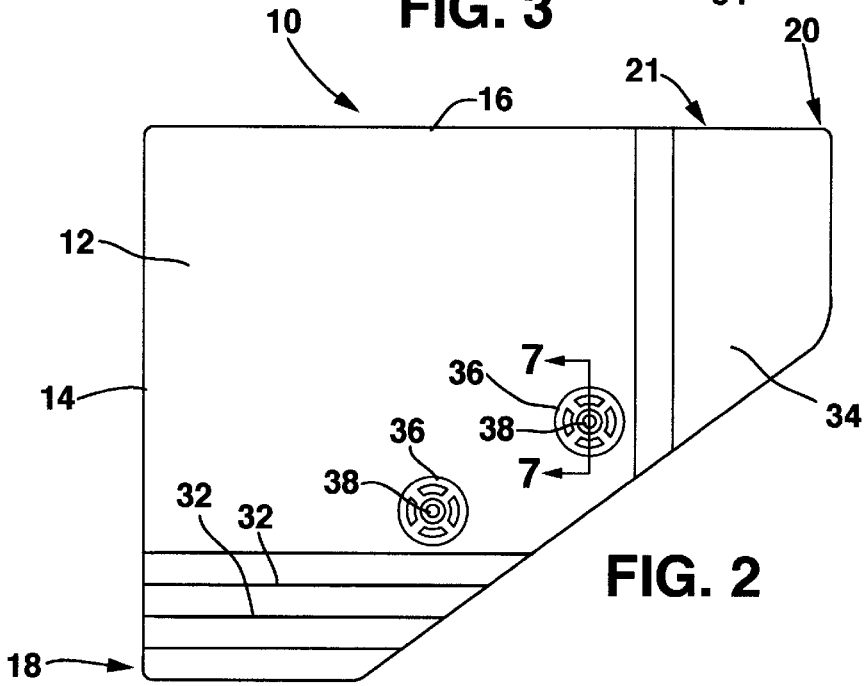
FIG. 2 is an elevational view of a universal modular tread and riser unit shown in FIG. 1.

A universal modular tread and riser unit 10 is shown in FIGS. 2–5 and includes spaced apart side walls 12. In a preferred embodiment, unit 10 is a one-piece unit, molded using an appropriate plastic that will not shatter with screw penetration into the plastic. A riser wall 14 extends between side walls 12 as shown in FIG. 3. Riser wall 14 has a free end 18. The other end of riser wall 14 is joined to an end of tread wall 16 which extends between side walls 12 and is oriented perpendicular to riser wall 14 as best seen in FIGS. 2–6. Tread wall 16 has a free end 20 as shown in FIGS. 2–3. Both riser wall 14 and tread wall 16 are sufficiently thick to securely hold screws used to secure treads and risers to units 10.

Figure 4:
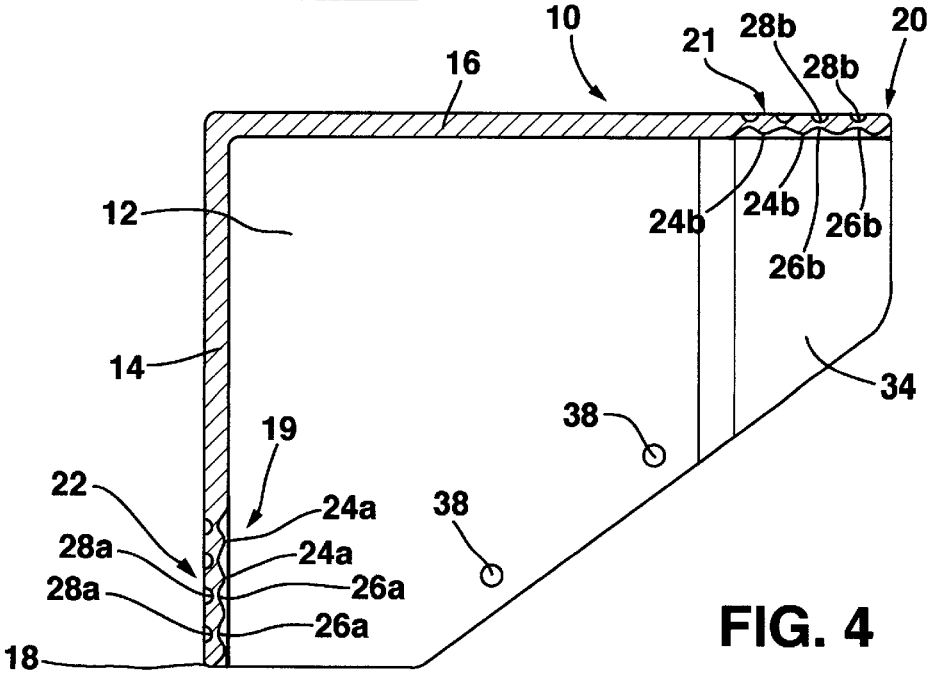
FIG. 4 is a cross-sectional view taken along the line 4—4 in FIG. 3.
Figure 5:
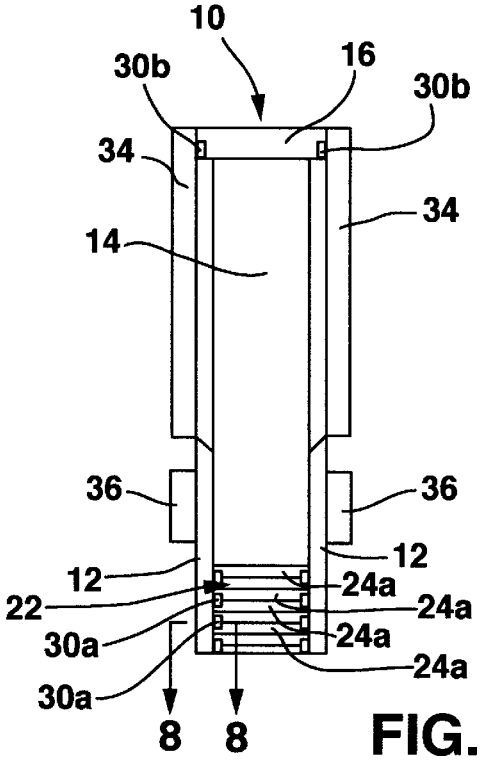
FIG. 5 is a right end view of the invention shown in FIG. 2.
Figure 8:
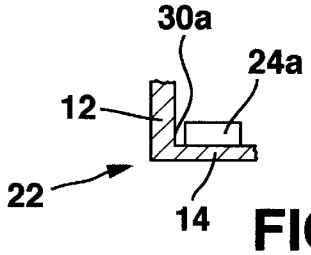
FIG. 8 is an enlarged cross-sectional view taken along the line 8—8 in FIG. 5.
Figure 10:
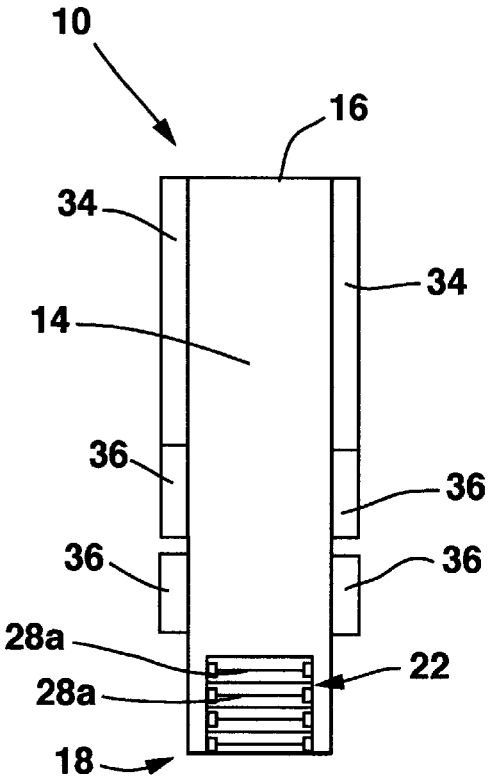
FIG. 10 is a left side view of the invention shown in FIG. 2.

Modular unit 10 also includes a riser sizing portion 19 located at the free end 18 of riser wall 14 as seen in FIG. 2. Riser sizing portion 19 has several breakaway sections 22 extending between side walls 12 as best seen in FIGS. 4, 5 and 8. Breakaway sections 22 include triangular grooves **26*a* forming lands 24*a* in between. On the opposite side of riser wall 14, grooves 28*a*, as best seen in FIGS. 4 and 10, are formed opposite grooves 26*a*. A weak piece of plastic is left between grooves 26*a* and 28*a* so that a break can occur between these grooves. Also at each end of lands 24*a*, as best seen in FIGS. 5 and 8, several holes 30*a* are also formed which weaken each land 24*a* near its attachment to side walls 12. These weakened walls of plastic permit any number of the lands 24*a* to be broken away from unit 10 using just a pair of pliers. The pliers can be used to grasp an appropriate number of lands 24*a*. By twisting the pliers, the lands 24*a* may be broken away from unit 10. The break formed in the above-described manner leaves a smooth, accurate break along one of the grooves 26*a*. On the outside surface of side walls 12, lines 32 can also be printed and numbered to delineate the length of the riser wall 14** to be broken away.

Figure 9:
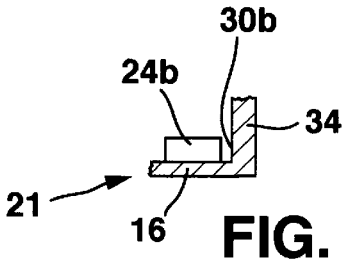
FIG. 9 is an enlarged cross-sectional view taken along the line 9—9 in FIG. 6.
Figure 6:
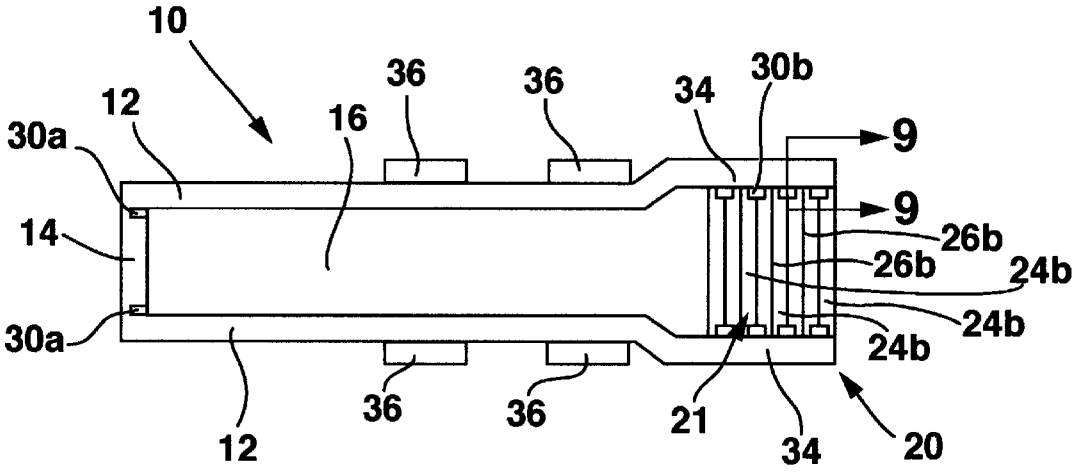
FIG. 6 is a bottom plan view of the invention shown in FIG. 2.

Modular unit 10 also includes a tread sizing portion 21 located at the free end 20 of tread wall 16. Tread sizing portion 21 includes lands **24*b* separated by grooves 26*b* as best seen in FIGS. 4 and 6. Grooves 28*b*, as best seen in FIG. 3, are formed on the opposite side of tread wall 16 opposite grooves 26*b* to provide a weakened portion of plastic. Also, as best seen in FIG. 9, at the ends of each land 24*b*, holes 30*b* weaken the plastic so that a clean break can be made along any groove 26*b* where a break is desired. Grooves 28*b*** may be labeled so as to delineate the length of the tread wall to be broken away.

Figure 7:
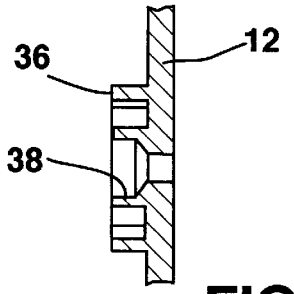
FIG. 7 is an enlarged cross-sectional view taken along the line 7—7 in FIG. 2.

Screw supports 36 are formed on each of the side walls 12. As best seen in FIG. 7, a screw support 36 includes a countersunk hole 38 through wall 12 that accommodates both the shank and the head of a screw within support 36.

Each of the side walls 12 are formed to bulge outwardly at walls 34 as shown in FIG. 3. With this configuration, walls 34 can be slipped over the side walls 12 of an adjacent unit 10 as shown in FIG. 1, to provide a smooth transition from one unit 10 to an adjacent unit 10.

In operation, a pair of stringers 40, usually 2×8s, are initially positioned in preparation for constructing a stairway. One such stringer 40 is shown in FIG. 1. The units 10 are used in pairs, one unit 10 placed on each stringer at opposite ends of the position where each step is to be located. A pair of pliers is used to remove an appropriate number of lands 24*a* on riser wall 14 and lands 24*b* on tread wall 16 so that when unit 10 is placed on stringer 40 the tread is horizontal and the riser is vertical. All of the units 10 can then be sized accordingly using the markings 32 and marked grooves 28*b*. A unit 10 is then positioned on stringer 40 and screws inserted in screw supports 36 to secure unit 10 to stringer 40. The next adjacent unit 10 is then positioned on stringer 40 with walls 34 inserted over side walls 12 of the first unit 10. This process is continued until all of the appropriate units have been secured to stringers 40.

Figure 1:
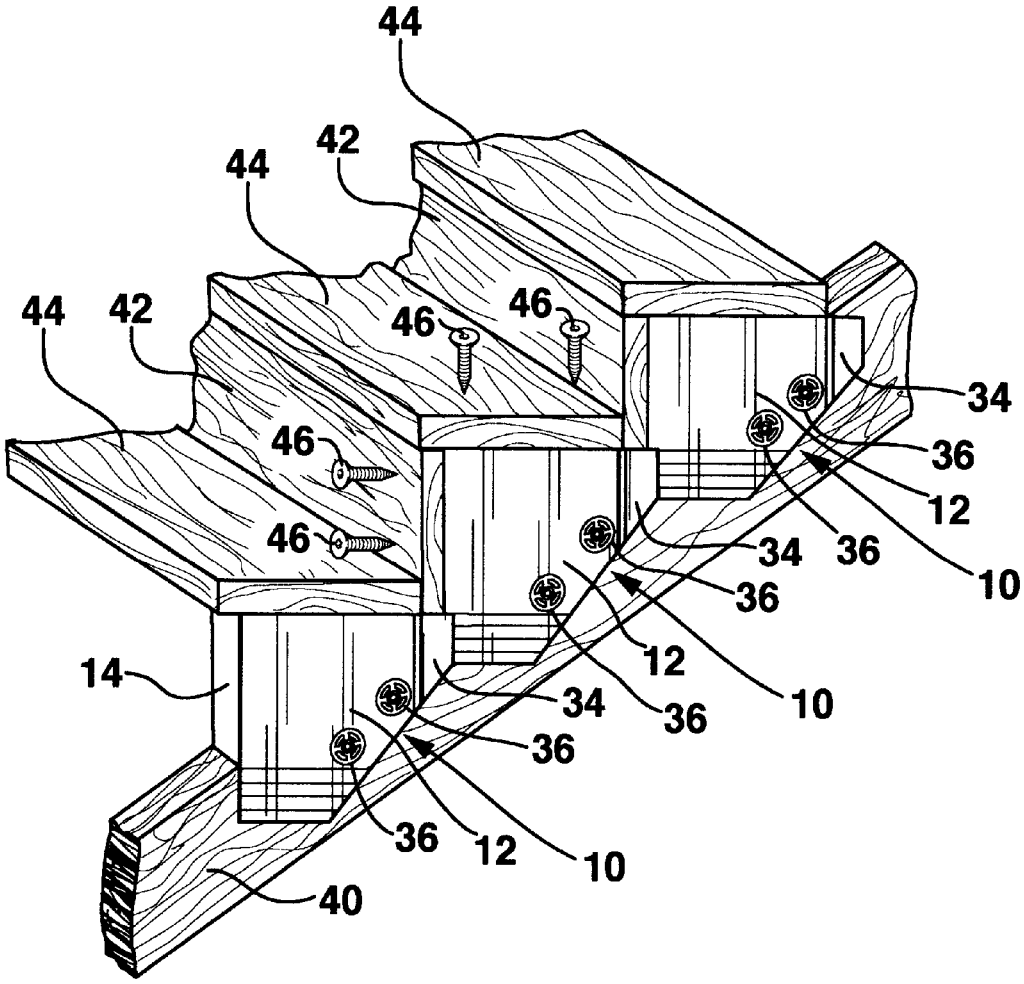
FIG. 1 is a perspective view of one side of a stairway with several universal modular tread and riser units installed with different degrees of step completion.

Once completed, a riser board 42 and a tread board 44 may be secured to units 10 with screws 46 as shown in FIG. 1.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims:

I claim:

1. A universal modular tread and riser unit for positioning on a stairway stringer having a predetermined slope, comprising:

an elongate tread wall having two ends, including a connecting end and a free end;

an elongate riser wall having two ends, including a connecting end and a free end;

the riser wall having its connecting end joined to the connecting end of the tread wall with the riser wall oriented in a depending perpendicular relation to the tread wall;

a pair of spaced apart side walls secured on either side of the joined tread wall and riser wall, the side walls spaced apart sufficiently to receive the stairway stringer with the free end of the tread wall resting on the stringer and the free end of the riser wall resting on the stringer;

a tread sizing means including breakaway sections located at the free end of the tread wall for sizing the length of the tread wall between the ends of the tread wall;

a riser sizing means including breakaway sections located at the free end of the riser wall for sizing the length of the riser wall between the ends of the riser wall;

whereby the length of the tread wall and the length of the riser wall can be sized so that when the unit is positioned on a stairway stringer having a predetermined slope, the tread wall is oriented in a horizontal direction and the riser wall is oriented in a vertical direction.

2. The unit according to claim 1 wherein the spaced apart side walls include an enlarged spaced apart portion for receiving the spaced apart side walls of an adjacent unit positioned on the stringer.

* * * * *